US010179984B2

(12) United States Patent
Bermingham et al.

(10) Patent No.: US 10,179,984 B2
(45) Date of Patent: Jan. 15, 2019

(54) DOCK BUILDING APPARATUS AND METHOD OF CONSTRUCTION USING THE SAME

(71) Applicant: SOLETANCHE FREYSSINET, Rueil Malmaison (FR)

(72) Inventors: Patrick Bermingham, Ancaster (CA); Eric Mellier, Viroflay (FR); Stefano Gabaldo, Hamilton (CA); Brice Le Treut, Aix-en-Provence (FR)

(73) Assignee: SOLETANCHE FREYSSINET, Rueil Malmaison (FR)

( * ) Notice: Subject to any disclaimer, the term of this patent is extended or adjusted under 35 U.S.C. 154(b) by 143 days.

(21) Appl. No.: 14/429,689

(22) PCT Filed: Sep. 21, 2012

(86) PCT No.: PCT/IB2012/002227

§ 371 (c)(1),
(2) Date: Mar. 19, 2015

(87) PCT Pub. No.: WO2014/045077

PCT Pub. Date: Mar. 27, 2014

(65) Prior Publication Data

US 2015/0218765 A1 Aug. 6, 2015

(51) Int. Cl.
*E02D 17/02* (2006.01)
*E02D 7/00* (2006.01)
(Continued)

(52) U.S. Cl.
CPC ..... *E02B 3/068* (2013.01); *B66C 17/06* (2013.01); *B66C 19/00* (2013.01); *E02B 3/20* (2013.01);
(Continued)

(58) Field of Classification Search
CPC ..... E02B 2017/0039; E02B 17/02; E02B 17/027; E02D 27/12; E02D 11/00;
(Continued)

(56) References Cited

U.S. PATENT DOCUMENTS 2,936,907 A * 5/1960 Woodruff ..... B66C 19/00 212/289
3,877,583 A * 4/1975 Bokenkamp ..... E21B 19/143 175/85
(Continued)

FOREIGN PATENT DOCUMENTS

JP 58222211 A 12/1983
JP S6375219 * 12/1983
(Continued)

*Primary Examiner* — Benjamin F Fiorello
*Assistant Examiner* — Edwin J Toledo-Duran
(74) *Attorney, Agent, or Firm* — Dentons US LLP

(57) ABSTRACT

A dock building apparatus comprises a cantilever arm (11) having a first portion configured to be supported on a ground area and a second portion for overhanging a construction area. The cantilever arm (11) is displaceable perpendicularly to the length of the cantilever arm. The apparatus further includes a lifting device (19) movable along the cantilever arm for bringing construction materials including foundation members from the ground area to the second portion of the cantilever arm, and a foundation building tool (15) movable along the cantilever arm for installing the foundation members in the construction area.

15 Claims, 3 Drawing Sheets

(51) Int. Cl.

| | |
|---|---|
| ***E02D 11/00*** | (2006.01) |
| ***E02B 3/06*** | (2006.01) |
| ***B66C 17/06*** | (2006.01) |
| ***B66C 19/00*** | (2006.01) |
| ***E02B 3/20*** | (2006.01) |
| ***E02D 7/06*** | (2006.01) |
| ***E02D 27/12*** | (2006.01) |
| ***E02D 27/16*** | (2006.01) |
| ***E02D 27/32*** | (2006.01) |
| ***E02D 27/52*** | (2006.01) |
| ***E02D 35/00*** | (2006.01) |
| ***E02D 29/00*** | (2006.01) |

(52) U.S. Cl.
CPC ..... *E02D 7/06* (2013.01); *E02D 11/00* (2013.01); *E02D 27/12* (2013.01); *E02D 27/16* (2013.01); *E02D 27/32* (2013.01); *E02D 27/52* (2013.01); *E02D 29/10* (2013.01); *E02D 35/005* (2013.01)

(58) Field of Classification Search
CPC .... E02D 5/22; E02D 7/00; E02D 7/02; E02D 13/04; E02D 27/525; B66C 17/06; B66C 19/00; B63B 21/24; B63B 21/26; E21B 41/08
USPC ..... 405/204, 218, 219, 220, 221, 224, 227, 405/228, 231, 232
See application file for complete search history.

(56) References Cited

U.S. PATENT DOCUMENTS 4,081,087 A * 3/1978 Freeman, Sr. ..... E21B 19/155 104/112
4,440,527 A * 4/1984 Vidal ..... E02B 3/066 405/262
4,711,601 A * 12/1987 Grosman ..... E02B 17/00 405/195.1
5,451,129 A * 9/1995 Boyadjieff ..... B65G 1/0442 414/22.61
5,570,975 A * 11/1996 Reinert, Sr. ..... E02D 7/26 173/184
6,082,931 A * 7/2000 Hopper ..... E02B 3/06 114/256
6,234,714 B1 * 5/2001 Chattey ..... E02B 3/06 405/8
6,609,573 B1 * 8/2003 Day ..... E21B 19/15 166/380
6,705,414 B2 * 3/2004 Simpson ..... E21B 15/003 175/52
6,715,964 B2 * 4/2004 Nottingham ..... E02D 5/02 405/278
6,901,998 B1 * 6/2005 Roodenburg ..... E21B 19/002 166/85.1
7,520,014 B2 * 4/2009 Homsi ..... E01D 19/103 14/77.1
8,215,874 B2 * 7/2012 Reeves ..... E02D 13/04 405/227
8,291,845 B2 * 10/2012 Wijning ..... B63B 35/4413 114/72
2002/0071743 A1 * 6/2002 Amoss, Jr. ..... B65G 67/603 414/137.9
2002/0092820 A1 * 7/2002 Chattey ..... B66C 19/002 212/325
2002/0197135 A1 * 12/2002 Arntzen ..... B63B 27/02 414/140.3
2004/0126205 A1 * 7/2004 Amoss, Jr. ..... B65G 67/603 414/138.5
2004/0151549 A1 * 8/2004 Roodenburg ..... E02B 17/021 405/201
2005/0011849 A1 * 1/2005 Chattey ..... B66C 19/002 212/270
2008/0219804 A1 * 9/2008 Chattey ..... B66C 19/002 414/140.3
2008/0298898 A1 * 12/2008 Roodenburg ..... E02B 17/00 405/196
2011/0299937 A1 * 12/2011 Cortina-Ortega ..... E02D 27/52 405/224

FOREIGN PATENT DOCUMENTS

JP S58222211 A * 12/1983
JP 61162630 A 7/1986
JP 61277716 A 12/1986

* cited by examiner

DOCK BUILDING APPARATUS AND METHOD OF CONSTRUCTION USING THE SAME

This application is a National Stage Entry of International Application No. PCT/IB2012/002227, filed on Sep. 21, 2012, which is incorporated herein by reference in its entirety.

BACKGROUND OF THE INVENTION

The present invention relates generally to a construction apparatus, and more particularly, to a dock building apparatus with a cantilever arm having a foundation building tool movable along the cantilever arm and arranged to build a dock along a shoreline.

Without implying any limitation to other types of construction and for the purpose of the present invention, the dock (or quay) is a general term used to describe a marine structure for the mooring or tying-up of vessels, and for loading and unloading of goods and passengers. It is generally contiguous with the shoreline.

The construction of quays falls broadly into two classifications: quays with a closed or solid construction, and quays with an open construction, where the deck is supported on piles. The deck of an open quay is supported on piles and the entire structure is open to full view.

The piles may either be in normally reinforced concrete, pre-stressed concrete, or steel. Piles in general may be divided into two broad categories: driven and in situ. Driven piles are piles driven into the ground by foundation tools. In situ piles are piles formed in the ground by first drilling a large diameter hole and then filling it with concrete and structural reinforcement. A combination of the two, also known as a cased or jacketed piles, typically comprise a steel pipe pile driven into the ground, emptied of its contents, and then refilled with reinforced concrete.

The construction of quays resting on piles is typically done using usual foundation building apparatus, for example piling or vibrating hammers installed on barges or on temporary decks placed on top of the piles already installed, or more simply on the shore.

A number of limitations result from this traditional method. For example, those relating to lengthy erection time, to difficulties associated with different types of ground (seabed) deposition and/or to the presence of rubble mounted breakwater, and to difficulties relating to the spacing and/or alignment of the pile lanes, due to the fact that the foundation equipment has limited reach, as it is designed to work on solid ground (shore) where close access to the foundation position is typical. This span limitation leads to non-optimal deck structures. Furthermore, the outcome of the construction process is affected, notably due to imprecise pile lane positions and to general construction inefficiencies.

It is an object of the present invention to solve the above-described problems and to provide an improved construction apparatus and method for construction of a dock (quays) with an open structure in civil engineering works.

SUMMARY OF THE INVENTION

The invention covers apparatus that enable the building of docks from the shore in an industrial manner. It also covers building methods using these apparatus. By using the present invention, it may be possible to dispense with marine works. Moreover, different steps in the construction of a quay structure such as fast pile driving and/or drilling, as well as deck erecting can be accomplished using with an all-in-one apparatus. Furthermore, a precise X-Y positioning of piles and deck can also be obtained.

The present invention provides a dock building apparatus comprising a cantilever arm having a first portion configured to be supported on a ground area and a second portion for overhanging a construction area, the cantilever arm being displaceable perpendicularly to its length; a lifting device movable along the cantilever arm for bringing construction materials including foundation members from the ground area to the second portion of the cantilever arm; and a foundation building tool movable along the cantilever arm for installing the foundation members in the construction area.

In an embodiment, the dock building apparatus further comprises a support member mounted on the second portion of the cantilever arm and arranged for bearing on ground in the construction area so as to support the second portion of the cantilever arm. Such support member is preferably located at a distal end of the cantilever arm, and/or retractable, by folding and/or lifting.

The lifting device may comprise at least one gantry crane slidable along the cantilever arm.

The foundation building tool comprises a pile driver in a particular embodiment.

The lifting device may be integrated with the pile driver and movable together with the pile driver along the cantilever arm to pick up piles and position such piles in a driving position of the pile driver. The pile driver may also be configured to install an inclined foundation by driving a pile at an angle with respect to a vertical direction.

In accordance with another aspect of the present invention, a method of building a dock using an apparatus as mentioned above is provided. The method comprises: arranging a cantilever arm at a first position along a shoreline such that the cantilever arm has a first portion supported on a ground area and a second portion overhanging a construction area; moving a foundation building tool along the cantilever arm to a position in the second portion prescribed for installing at least one foundation member; picking up the foundation member on the ground area with a lifting device mounted on the cantilever arm; moving the lifting device along the cantilever arm from the first portion to said prescribed position; installing the foundation member in the construction area using the foundation building tool; displacing the cantilever arm perpendicularly to the cantilever arm to a second position along the shoreline; and with the cantilever arm at the second position, repeating the steps of moving the foundation building tool along the cantilever arm, picking up at least one foundation member, moving the lifting device along the cantilever arm and installing the foundation member.

In an embodiment of the method, arranging the cantilever arm comprises placing a support member to bear on ground in the construction area so as to support the second portion of the cantilever arm, for example at a distal end of the cantilever arm.

The method may further comprise: picking up deck parts on the ground area with the lifting device; moving the lifting device along the cantilever arm from the first portion to the second portion of the cantilever arm; and installing the deck parts on the foundation members. The foundation members comprise piles driven into the ground using the foundation building tool, the deck parts typically comprise beams mounted on top of the piles and panels supported by the beams.

Yet another aspect of the present invention relates to a dock comprising a deck and a foundation comprising a plurality of piles installed using a method as defined above.

BRIEF DESCRIPTION OF THE DRAWINGS

Further features and advantages of the invention will become apparent by reading the following detailed description of the embodiments which are given by way of non-limiting examples with reference to the appended drawings, in which.

DESCRIPTION OF PREFERRED EMBODIMENTS

Figure 1:
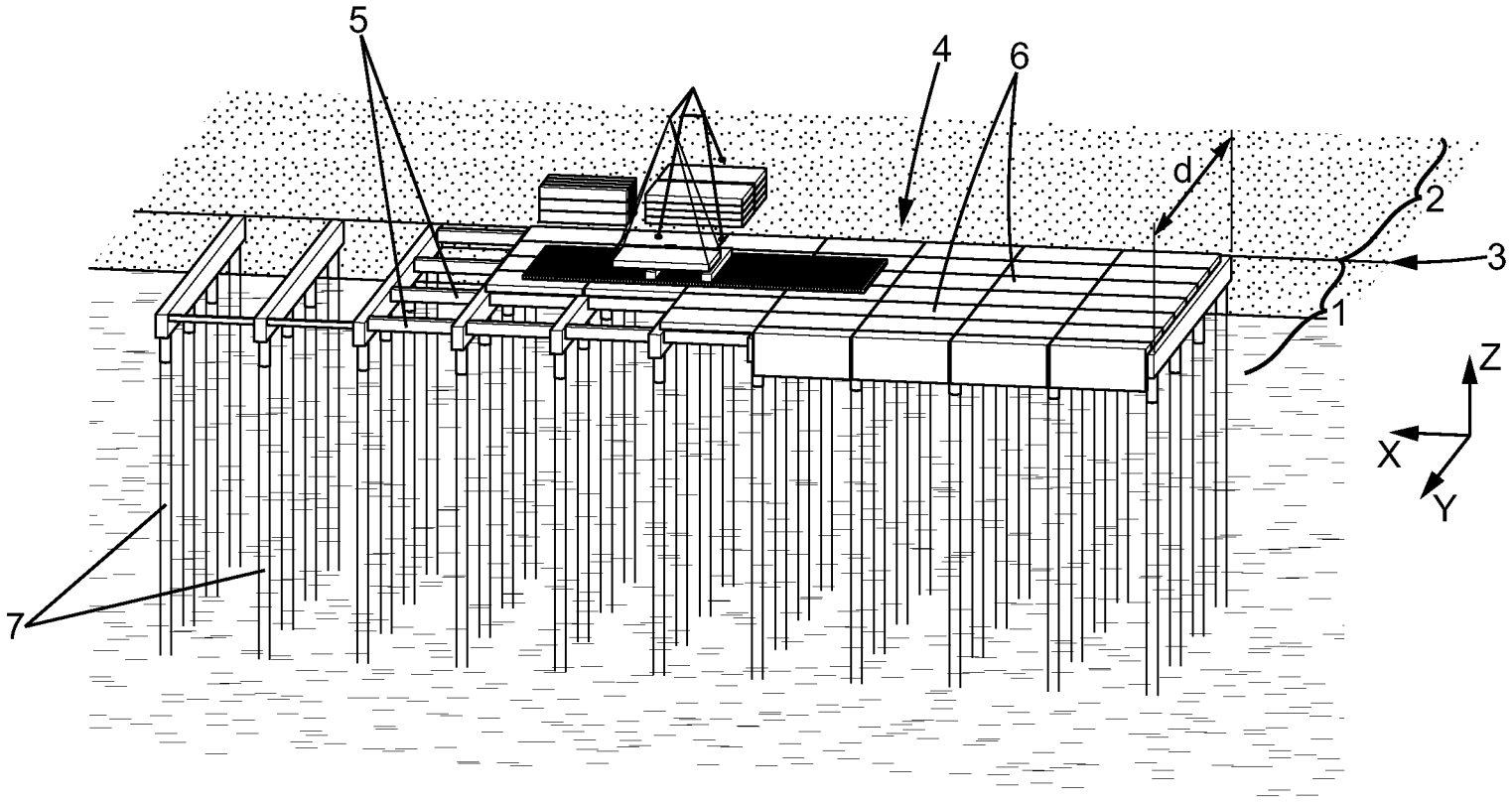
FIG. 1 is a perspective view of a dock under construction along a shore according to the prior art.

The construction shown in FIG. 1 is a dock 1 along a shore 2. The shoreline 3 extends along a longitudinal direction noted X in FIG. 1. The dock 1 has a deck 4 having a width d in a transverse Y with respect to the longitudinal direction X of the shore 2. The dock includes a plurality of prefabricated deck parts, for example beams 5 and deck panels 6, and a plurality of piles 7 arranged in a plurality of predetermined pile lanes according to the configuration of the dock. The piles 7 serve as foundation to support the deck 4.

The longitudinal and transversal directions in a plane of the quay constitute a two-dimension coordinate system. Inside of this system, sequential pile lanes extend transversally from the shoreline and are spaced apart in the X direction with a predetermined space between them. The piles from different lanes that are equidistant to the shoreline form a pile row. In this way, each pile can be allocated with precise X-Y coordinates to form an array defined before the construction of the quay. Each pile lane corresponds to a working position of the construction apparatus in the longitudinal direction X, and each pile row corresponds to a driving position of the foundation building tool along the cantilever arm 11 of the apparatus.

Figure 2:
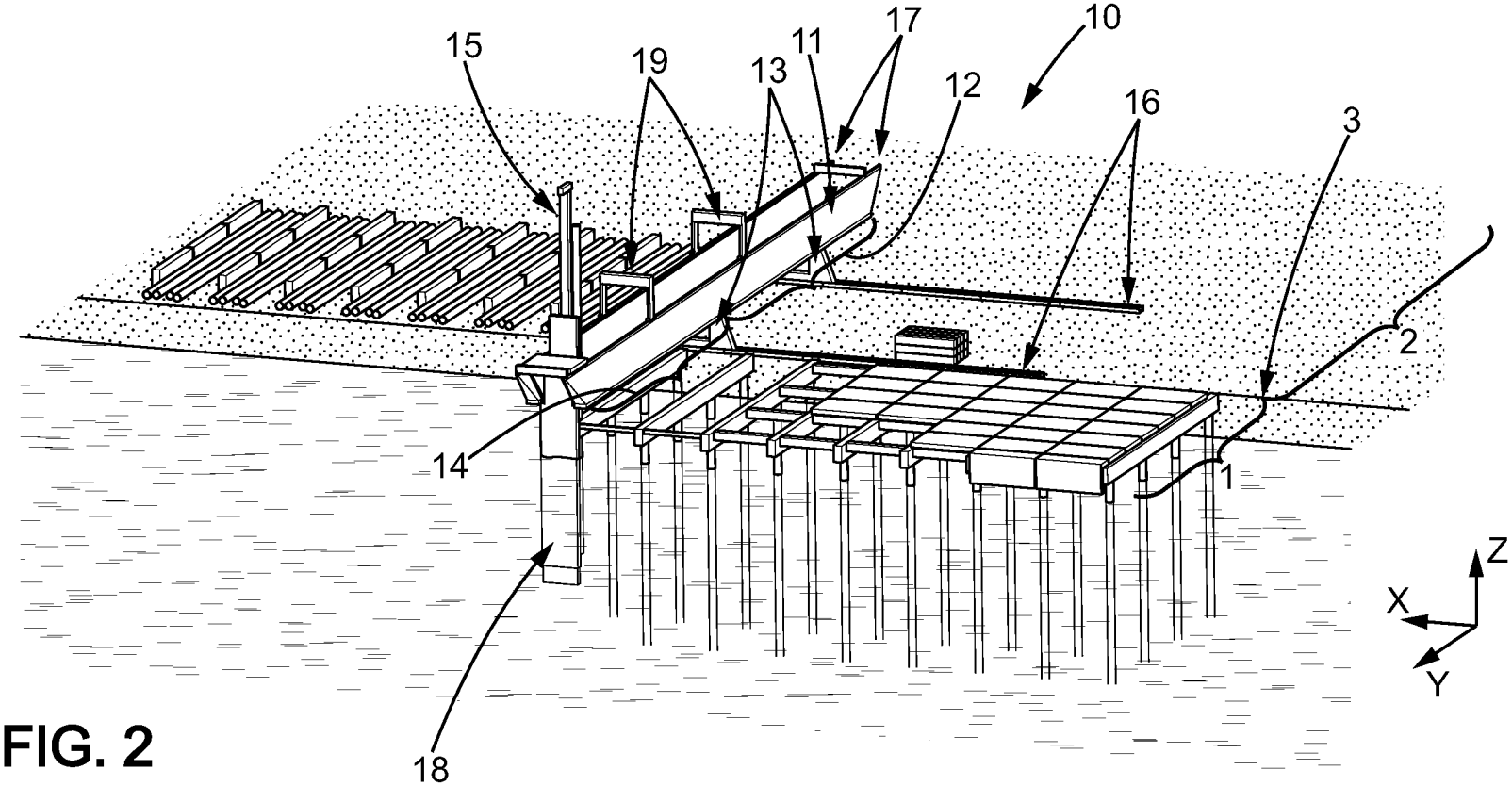
FIG. 2 is a perspective view of an apparatus for building a dock according to an embodiment of the invention.

The dock building apparatus depicted in FIG. 2 is a multi-functional apparatus for building a dock. Herein, the term "multi-functional" is defined as being capable of carrying out various steps in the construction of a dock, for example, driving/drilling piles, lifting loads, erecting a deck, dredging the sea bed or channels, etc.

Any pile driving technologies known in the art can be used in the dock building apparatus of FIG. 2.

In a configuration for driving piles along the shore 2, the dock building apparatus 10 includes a cantilever arm 11 arranged in the transversal direction X of the width of the dock. The cantilever arm 11 is a substantially horizontal structure having a first portion 12, i.e. a gantry portion, configured to be supported on a ground area, i.e. the shore 2, for example via two or more supports 13. A second portion 14 of the cantilever arm 11, i.e. a cantilever portion, is configured to cantilever from the ground supports 13 so as to overhang a construction area. The construction area may be under water, but this is not always the case.

One or more foundation building tool(s), for example a pile driver 15, is installed on the cantilever arm 11 and movable along the cantilever arm 1, i.e. along direction Y, for installing foundation members in the construction area.

A lifting device 19 is arranged to movable along the cantilever arm 11 for bringing construction materials, including foundation members, from the ground area to the second portion of the cantilever arm 11 over the construction area.

The supports 13 of the apparatus 10, arranged in a line perpendicular to the shoreline, are movable along the shore. Thus the cantilever arm 11 has the ability to displace perpendicularly to the length of the cantilever arm, i.e. to be moved sidewards following the longitudinal direction X of the shore.

To this end, these supports can rest by moving means such as wheels, on fixed or temporary skidways 16 arranged along the shore. The supports 13 spread the heavy loads from the apparatus 10 on the shore ground. Such configuration also limits the need for heavy temporary foundations. The skidways 16 can be segmental and removable in such a way as to accompany the advancement of the apparatus 10 comprising the cantilever arm 11.

The cantilever arm 11 of the apparatus 10 is typically constituted of two parallel steel beams 17, for example, in the form of a truss or box girders. The cantilever arm 11 also has a second portion 14 configured to overhang the construction area and to cantilever from the ground supports 13 in direct extension of the gantry portion 12. Such a structure is similar to a conventional rail-mounted gantry crane used in harbour operations. However, the gantry span of the gantry part and the outreach of the cantilever part of the cantilever arm 11 are both large enough to facilitate and adapt to main works in the construction of quays, such as transporting and driving piles and other materials, erecting decks, dredging, etc.

The outreach of the cantilever part of the cantilever arm is, for example, of the order of several tens of meters, making it possible to build quays that may extend to deep water, for mooring or tying-up of deep-draft vessels.

When configured for driving piles, the dock building apparatus is equipped with at least a foundation building tool, for example a pile driver 15 (a piling or vibrating hammer, or a rotary core driller, etc), to drive piles into the ground of the construction area. The pile driver 15 is movable along the cantilever arm 11 of the apparatus. The pile driver is typically installed on a trolley that rolls on to rails fixed on the two parallel trusses. When in position for loading a pile, the pile driver can be movable to pick up the pile by appropriate lifting means, for example integrated on to the pile driver by cables and pulleys equipped on the head of the pile driver. Preferably, the pile is picked up by other lifting means mounted on the cantilever arm which will be described below.

When the pile driver is charged with a pile, it can normally be turned and locked on a vertical position on the cantilever part 14, the pile is then driven into the ground.

The pile driver can also be inclined at an angle with respect to a vertical direction Z to install an inclined foundation by locking the pile driver at an inclined position at the predetermined angle and driving the pile at this angle. The inclined position may be at any angle around the vertical position of the pile driver and towards the ground of the construction area. The pile driver is advantageously installed backwards, facing the shore, in order to facilitate the installation of the pile in the pile driver.

During the foundation works, an additional temporary support is advantageously used to stabilize the apparatus and to avoid equipment damage caused by impact and/or vibration during pile driving. The apparatus 10 is then equipped with an additional support member 18, a front leg for example, mounted on the second portion 14 of the cantilever arm 11, in order to support the part of the cantilever arm which extends beyond the shoreline.

The support member 18 is preferably retractable and installed at a distal end of the cantilever portion. It is designed to bear on ground in the construction area (sea bed), so as to support the second portion of the cantilever arm during driving work. When the apparatus needs to be moved or when the operation does not require this support member, it is retracted. Retraction can be obtained by folding or lifting as known in the art.

To pick up piles from the ground area and to transport them along the cantilever arm and to deliver them to the pile driver, the apparatus 10 is preferably equipped with a separate lifting device, for example at least one gantry crane 19 mounted on, and slidable along the cantilever arm 11. The term "separate" means that such lifting device is distinct from the pile driver and can be used independently.

Figure 3:
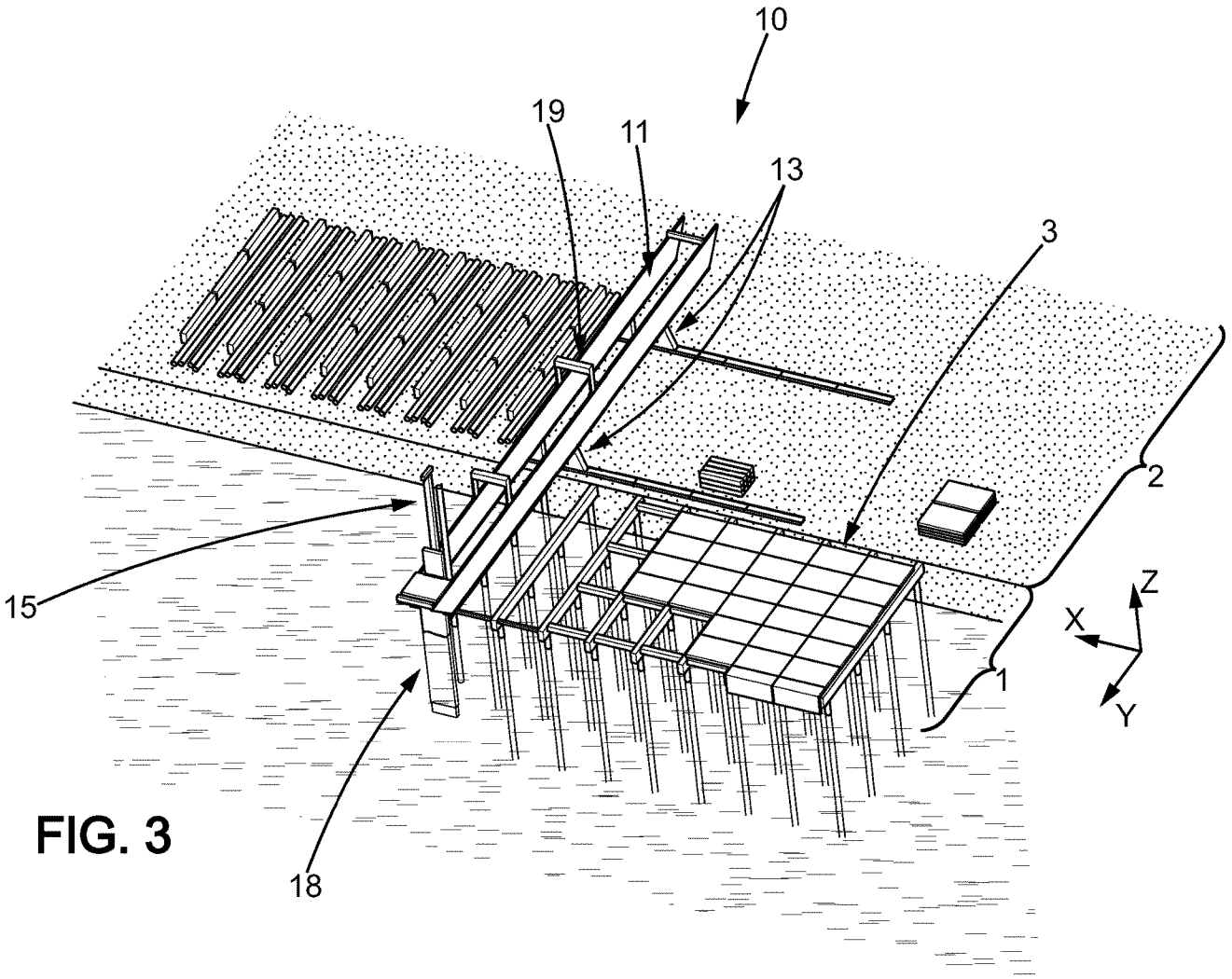
FIG. 3 is another perspective view of a dock under construction using the apparatus according to the embodiment of FIG. 2.

To facilitate logistics, the piles are typically stored on the ground area and proximate the ground supports 13, for example adjacent to the two parallel trusses 17 of the cantilever arm and between the skidways receiving the two ground supports 13 as shown in FIG. 3. The piles are picked up by the lifting device 19, for example the gantry cranes and moved along the cantilever arm 11 together with the lifting device 19 to the cantilever portion 14 and to the pile driver 15. The pile is then delivered and installed to the pile driver by appropriate means installed, for example, on the head of the pile driver as known in the art. If the lifting device is integrated on to the pile driver (not shown in figures), it is the pile driver itself moving to pickup the pile.

Before the construction of quays, the apparatus is assembled on the ground area by arranging the cantilever arm 11 at the first position along the shoreline such that the first (gantry) portion 12 of the cantilever arm 11 is supported on the shore ground and the second (cantilevered) portion 14 overhangs the construction area.

The cantilever arm 11 can be assembled along the shore and rotated. It can also be assembled in the alignment of its working position and launched.

During the construction of quays, as illustrated in FIG. 3, foundations are first built, typically using piles. To this end, the apparatus is placed to have the cantilever arm 11 aligned with a predetermined pile lane $X_n$ (n=1, 2, . . . , N), where N is the maximum number of pile lanes. If necessary, the temporary front leg 18 is installed to provide additional support and stiffen the cantilever arm 11, as foundation works can create heavy loads and significant vibrations in the structure.

The pile driver 15 then moves along the cantilever arm 11 to a position in the second portion 14 prescribed for installing at least one foundation member. Such prescribed position is referred to as $Y_m$ (m=1, 2, . . . , M), where M is the maximum number of pile rows.

The movable gantry crane 19 mounted on the cantilever arm 11 picks up one pile on the ground area and moves along the cantilever arm from the first portion 12 to the second portion 14. The pile picked and transported by the gantry crane 19 is then delivered to the pile driver 15, preferably above the prescribed position for driving.

The pile is then installed on the pile driver and driven at the prescribed position $Y_m$ into the construction area. The pile driver 15 can then be moved to a next pile position $Y_{m+1}$ in the same lane $X_n$, and the sequence is executed once more for this next pile ($X_n$, $Y_{m+1}$).

Once all the piles of a lane $X_n$ are installed, the support member 18 is retracted. The apparatus 10 comprising the cantilever arm 11 is then moved sidewards along the shoreline in the longitudinal direction X to a next pile lane $X_{n+1}$. The piles intended for the next pile lane $X_{n+1}$ have been stored near the X position of the pile lane $X_{n+1}$. The same sequence as mentioned above is repeated until the building of the piles is completed.

Alternatively, the piles of a row can be driven at first, meaning that the apparatus drives firstly all piles at a predetermined same pile row $Y_m$, preferably the first row $Y_1$ from the shoreline. Then piles of different pile rows are driven until the building of the whole pile array is completed.

In some configurations, for example for building quays on both sides of an island or peninsula, the apparatus can have two cantilevered portions 14 extending on both sides of a common gantry portion 12 and extending beyond the ground area. In such a configuration, it may be useful to arrange more gantry cranes along the arm 11 to facilitate the handling of piles and to perform simultaneous building steps on both sides.

In addition to driving piles, the apparatus according to invention can be used in others steps of quay construction such as lifting materials, erecting decks, dredging sea bed . . . , etc. As such, a single apparatus can perform most of the main works of construction. Consequently, the performance and efficiency of construction are improved.

For example, the apparatus can be used to erect a deck. With its ability to move sidewards and the gantry cranes moving along the cantilever arm, the deck panels can be delivered to any point in the design. To this end, the lifting device 19 picks up deck parts on the ground area and moves along the cantilever arm from the first portion to the second portion of the cantilever arm, in order to install the deck parts on the foundation members.

The apparatus can be used to install prefabricated steel and/or concrete elements (beams, panels). It can also be used as a support for concreting equipment. In this situation, the front leg may not be used in order to avoid slowing down the process.

Additionally, pile driving and deck erecting can be performed in the same sequence or in consecutive sequences, by the same apparatus or by a combination with a another separate apparatus, for example with a conventional movable crane as illustrated in FIG. 1 for erecting decks if required by conditions of construction.

Once the deck is built, the apparatus can also be moved forwards, cantilevering in front of the quay. At that time it can be used to dredge in front of the quay.

The longitudinal and transversal movements of the apparatus in a plane of the dock constitutes a two dimensions coordinate system, inside of which each pile is allocated with precise X-Y coordinates. Therefore, each pile can be driven at a precise position predetermined according to a configuration of the quay. This results in a precise construction of deck elements. The precision and efficiency of driving and erecting works can be significantly improved over conventional methods, as onshore or barge-based pile drivers and cranes depend on the experience of an operator, on geographical condition, on weather and so on.

When working together with known positioning systems and/or remote systems, the pile-driving and deck erecting operations can also be automated using a simple X-Y movement of a controlling device, for example a computer. As will be appreciated, the X-Y movement of the foundation building tool according to the invention is scalable to large scale constructions, for example, in a 50×350 meter reach, for quays used to dock, for example, the latest generation of container vessels or bulk carriers.

Thanks to the potentially large span of the cantilevered portion, the construction apparatus of the present invention is especially advantageous in construction areas where side access to construction on piles is often difficult or impossible.

Many modifications and variations of the present invention are made possible in light of the above teachings. For example, more or different foundation apparatus and lifting devices can be arranged on the cantilever arm; piles or other construction materials can also be stocked under another cantilever part if needed instead of under the gantry part. Furthermore, the dock building apparatus of the present invention can also be used in other fields of construction, for example in side-extensions of bridges or roads or other constructions on piles . . . , etc. It is therefore to be understood that within the scope of the appended claims, the invention may be practised otherwise than as specifically described.

The invention claimed is:

1. A dock building apparatus, comprising:

a cantilever arm comprising two parallel beams, the cantilever arm having, in a length direction, a first portion configured to be supported on a ground area and a second portion for overhanging a construction area, wherein the cantilever arm is displaceable perpendicularly to the length of the cantilever arm;

a lifting device mounted on the cantilever arm and movable along the length of the cantilever arm, the lifting device configured to pick up construction materials including foundation members from the ground area and to move said construction materials to the second portion of the cantilever arm, wherein the lifting device and the construction materials move together along the cantilever arm; and a foundation building tool movable along the cantilever arm for installing the foundation members in the construction area.

2. The dock building apparatus of claim 1, further comprising a support member mounted on the second portion of the cantilever arm and arranged for bearing on ground in the construction area so as to support the second portion of the cantilever arm.

3. The dock building apparatus of claim 2, wherein the support member is located at a distal end of the cantilever arm.

4. The dock building apparatus of claim 2, wherein the support member is retractable.

5. The dock building apparatus of claim 4, wherein the support member is retractable by folding and/or lifting.

6. The dock building apparatus of claim 1, wherein the lifting device comprises at least one gantry crane slidable along the cantilever arm.

7. The dock building apparatus of claim 1, wherein the foundation building tool comprises a pile driver.

8. The dock building apparatus of claim 7, wherein the lifting device is integrated with the pile driver and movable together with the pile driver along the cantilever arm to pick up piles and position such piles in a driving position of the pile driver.

9. The dock building apparatus of claim 7, wherein the pile driver is configured to install an inclined foundation by driving a pile at an angle with respect to a vertical direction (Z).

10. A method of building a dock, the method comprising:

arranging a cantilever arm comprising two parallel beams at a first position along a shoreline such that the cantilever arm has, in a length direction, a first portion supported on a ground area and a second portion overhanging a construction area;

moving a foundation building tool along the length of the cantilever arm to a position in the second portion prescribed for installing foundation members;

picking up a foundation member on the ground area with a lifting device mounted on the cantilever arm;

moving the lifting device along the length of the cantilever arm from the first portion to said prescribed position, wherein the lifting device and the foundation member move together along the cantilever arm;

installing the foundation member in the construction area using the foundation building tool;

displacing the cantilever arm perpendicularly to the length of the cantilever arm to a second position along the shoreline; and with the cantilever arm at the second position, repeating the steps of moving the foundation building tool along the cantilever arm, picking up another foundation member, moving the lifting device along the cantilever arm, and installing the other foundation member.

11. The method of claim 10, wherein arranging the cantilever arm comprises placing a support member to bear on ground in the construction area so as to support the second portion of the cantilever arm.

12. The method of claim 11, wherein the support member is placed at a distal end of the cantilever arm.

13. The method of claim 10, further comprising:

picking up deck parts on the ground area with the lifting device;

moving the lifting device along the cantilever arm from the first portion to the second portion of the cantilever arm; and installing the deck parts on the foundation members.

14. The method of claim 13, wherein the foundation members comprise piles driven into the ground using the foundation building tool, and the deck parts comprise beams mounted on top of the piles and panels supported by the beams.

15. A dock comprising a deck and a foundation comprising a plurality of piles installed using a method according to claim 10.

* * * * *